United States Patent [19]

Hyland et al.

[11] 3,963,110

[45] June 15, 1976

[54] STORAGE MAGAZINE AND SHEET FEEDER FOR TYPING APPARATUS

[75] Inventors: Francis P. Hyland, Wauwatosa; Phillip J. Tollefson, Milwaukee; Harlan J. Pilon, Waukesha; Hugo E. Borchert, Milwaukee, all of Wis.

[73] Assignee: Hy Grip Products Co., West Allis, Wis.

[22] Filed: June 26, 1974

[21] Appl. No.: 483,403

[52] U.S. Cl. ..... 197/130; 197/20; 197/127 R

[51] Int. Cl.[2] ..... B41J 13/02; B41J 13/10

[58] Field of Search ..... 197/19, 20, 127 R, 128, 197/130, 133 R, 114 R, 120

[56] References Cited

UNITED STATES PATENTS

| | | | |
|---|---|---|---|
| 2,813,612 | 11/1957 | Berglund et al. | 197/130 |
| 3,430,748 | 3/1969 | Parri | 197/114 R X |
| 3,658,163 | 4/1972 | Sniderman | 197/133 R |
| 3,684,076 | 8/1972 | Crain et al. | 197/127 R |
| 3,804,226 | 4/1974 | Ellis | 197/133 R |

*Primary Examiner*—Edgar S. Burr
*Assistant Examiner*—R. E. Suter
*Attorney, Agent, or Firm*—Andrus, Sceales, Starke & Sawall

[57] ABSTRACT

An automatic sheet feeder for a tape driven typewriter includes a blank-sheet magazine and a filled-sheet magazine mounted above the platen. Sheet feed rollers are mounted to transfer the sheets to and from the platen and are coupled to a motor in combination with the typewriter platen. An electric clutch connects the platen to the normal line step drive. The clutch is disengaged simultaneously with energization of the motor so as to disengage the platen from the normal step drive during automatic feeding. A photoelectric encoder is coupled to the normal step drive and is activated to record the movement of the sheet through the typewriter. A presetable memory counter and a run counter detect a predetermined output of the encoder. The encoder is first connected to the memory counter. The first sheet is manually fed into the typewriter and the memory counter stores a record of the selected number of lines through which the sheet passes. The operator terminates the typing and then connects the encoder to the run counter. The next sheet is manually fed to the typewriter and an automatic control established. The memory counter and run counter are connected to the comparator to automatically control the motor and clutch. The automatic typewriter is independently programmed with means to establish an automatic delay between typing of pages to permit automatic feed of sequential sheets into the machine.

8 Claims, 5 Drawing Figures

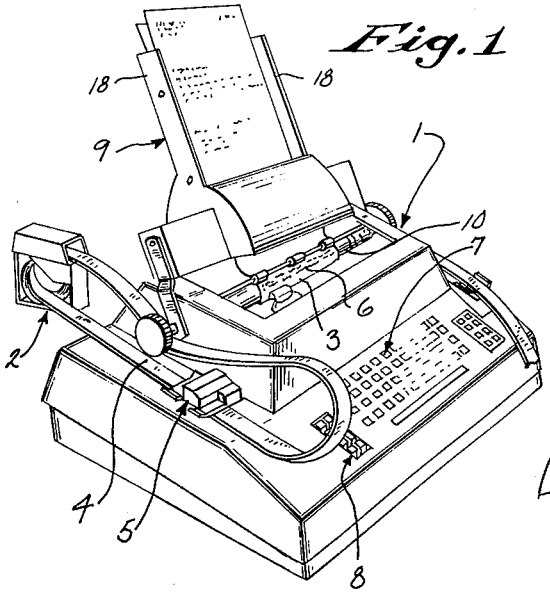
Fig. 1
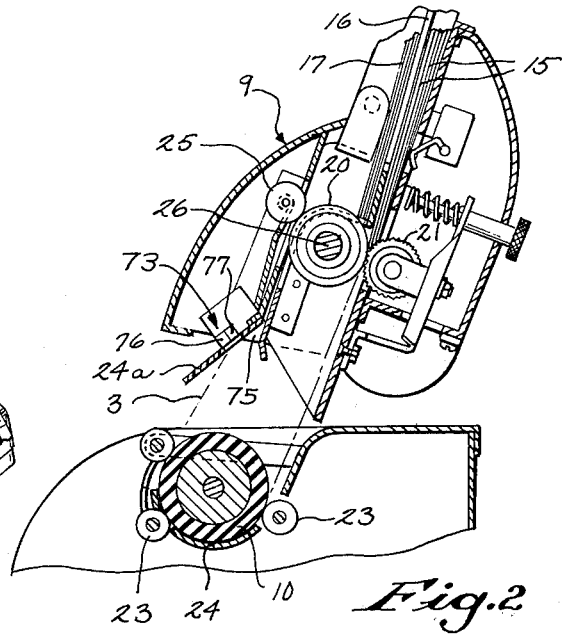
Fig. 2
Fig. 3
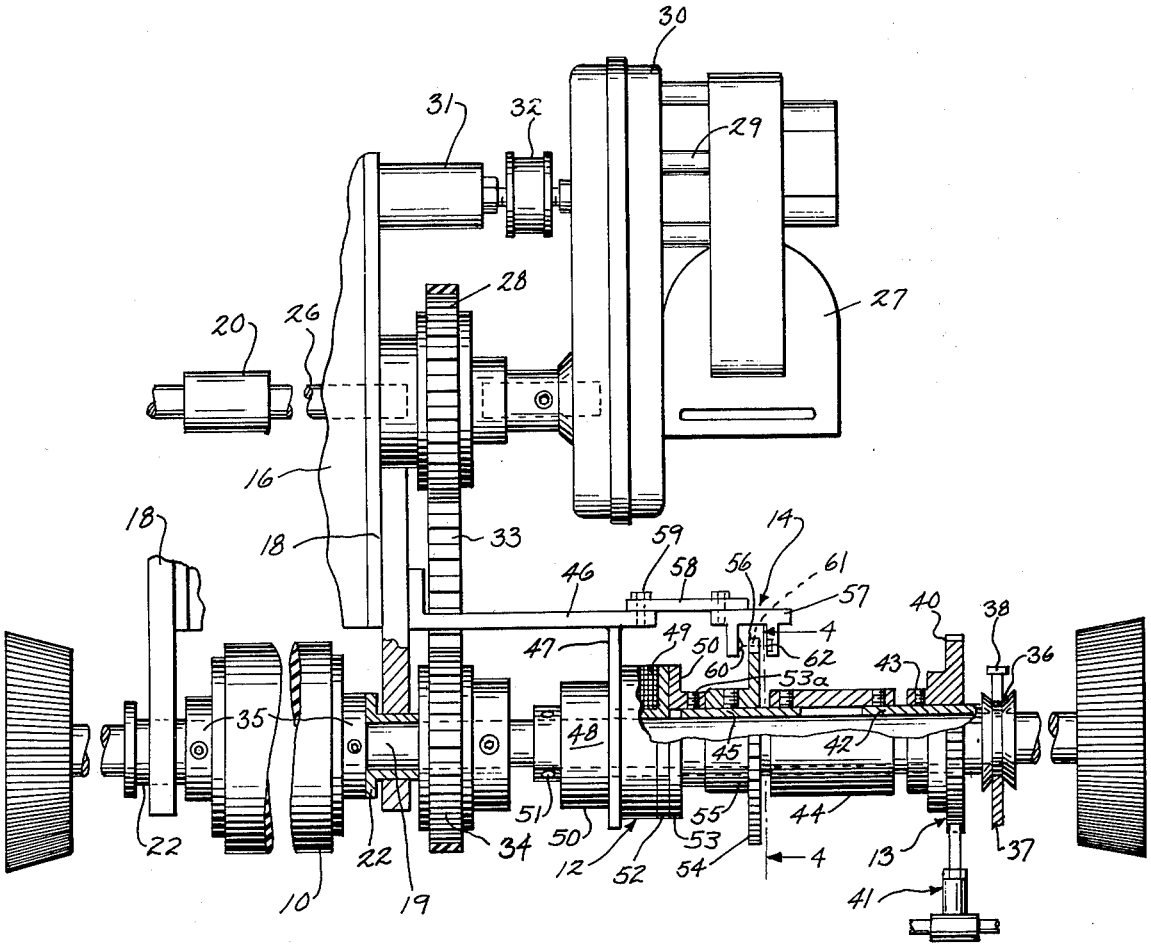

STORAGE MAGAZINE AND SHEET FEEDER FOR TYPING APPARATUS

BACKGROUND OF INVENTION

This invention relates to a method and apparatus for automatic feeding of sheets into a typing apparatus for the automated typing of corresponding material on separate sheets.

To partially automate the typing process and increase the typing rate, automatic sheet feeder means have been devised for manually operated typewriters in which a single sheets, carbon pack set and the like is fed into the typewriter by autucation of the platen. A satisfactory automatic sheet feeder means of this type is disclosed in U.S. Pat. No. 3,430,748. As more fully disclosed therein, the sheets to be sequentially fed into the typewriter are carried by a storage unit mounted immediately above the conventional platen. The blank sheets are stored immediately above a pair of feed rollers with means provided to allow a single sheet to drop down between the rollers. The feed rollers in turn are coupled to the platen and are driven from the conventional platen ratchet drive which is coupled to a motor. When the motor is energized, the unit provides automatic feeding of a new sheet into the typewriter. As the sheet is filled, it moves upwardly into a storage compartment in the storage unit. The feed system also includes an interlocking mechanically activated switch responsive to the incoming new sheet to insure continued movement thereof until it is moved inwardly to appropriately align the first line position in the typewriter. Once introduced, the typewriter operator activates the typewriter in accordance with the conventional manner. Thus, the operator activates the feeder to automatically feed the paper through the unit. The system thus permits delivery of the sequential sheets in the proper order and in an essentially automatic manner in response to the manual operation of the typewriter. The system thus eliminates the need of the operator separately inserting sheets and/or the necessity of using a continuous form.

Electric typewriters have been developed with computerized control for reproducing of previously typed material upon sheets which are controlled through a special magazine or form. The material when first typed is recorded in a suitable memory means such as a punched tape, magnetic tape or the like. The stored material may be reproduced by feeding of the memory unit into computer means of the typewriter which responds to reproduce the stored material in appropriate form on the typing forms inserted into the typewriter. In such systems, a continuous form is generally employed or a special computer control for the paper feed. Although such devices improve the capability of the electric computerized typewriters, the control is interrelated to the memory unit with the paper sheet being directly controlled by the tape and interrelated typing apparatus.

SUMMARY OF PRESENT INVENTION

The present invention is particularly directed to a method and apparatus for automatic feeding of sheets into the typing apparatus with an independent control mechanism and to thereby permit the sequential feeding of the sheets into the typing apparatus in accordance with a predetermined plan. In particular, the present invention is directed to an automatic memory system including a master memory means including an encoding means to sense the desired number of lines the sheet has moved and thereby providing a means for monitoring the the operation of the typing apparatus and the position of the typing material and, further, to automatically actuate a power feed drive means to feed the following or next sheet into the typing apparatus independently of the conventional platen type drive. The feeder device is essentially independent of the typing device and particularly the automated typing memory control other than to insure an interlocking control to terminate typing during the transfer period.

In accordance with one aspect of the present invention, a counting unit or means is coupled to the typing apparatus to automatically count stepped movement of the sheet through the apparatus. An interlocking control means includes a memory unit in which the number of desired steps or lines to be typed are preset and stored. The preset number is compared with the actual number and the apparatus automatically responds to the output of the comparator to provide for the powered transfer of a subsequent sheet upon establishing the movement of the sheet through the unit in accordance with the preset number.

In accordance with a particularly novel and important feature and construction of the present invention, a sheet feed means is coupled to a prime mover such as a motor in combination with the typewriter platen means. A clutch means also interconnects the platen means to the normal step drive means. The clutch means is disengaged simultaneously with energization of the motor so as to disengage the platen from the normal step drive means. A line or step counting means is coupled to the normal step drive means. After the sheet is automatically fed into the typing apparatus, the motor is disengaged, the clutch means is reset to again engage the normal step drive and the operation of the typing apparatus operates in accordance with the conventional sequence to automatically type on the sheet. Simultaneously, therewith however, the line or step counting means is activated to record the movement of the sheet through which the typewriter moves. When the predetermined stepped movement is reached, a signal is automatically generated to terminate the typing and introduce the subsequent sheet by again driving of the motor and disengaging of the clutch means.

In a further novel aspect of the optimum construction, the counting means is selectively coupled to a pair of counters, one of which constitutes a memory counter and the other of which constitutes a run counter. In a setup operation, the counting means is first connected to the memory counter. The first sheet is manually fed into the typing apparatus which is activated to type a predetermined number of lines on the first sheet. As the typing apparatus proceeds, the step signals are stored in the memory counter to establish a record of the selected number of lines through which the sheet passes. The operator, at the end of the predetermind number of lines, automatically terminates the typing and connects the counting means to the run counter. The next sheet is also manually fed into the unit and the unit switched to an automatic condition. The typing apparatus will now go through the same sequence but the step or line signals are fed into the run counter. The memory counter and run counter are connected to the comparator. The typing apparatus is independently programmed with means to establish an automatic delay between typing of pages to permit automatic feed of sequential sheets into the machine. A manual override is provided to permit the manual introduction of the sheets as desired.

Means are also provided for automatic resetting of the run counter between the termination of the automatic typing and the initiation of a new typing cycle. Thus, a switch means, such as a mechanical switch or a photo sensitive switch or the like, may sense the proper feed position of the new sheet to automatically reset the counter with the termination of the paper feed; for example, by automatically groundsing the reset of a solid state counting circuit. Further, suitable means are provided to reset both the run counter and the memory counter to permit the setting of the apparatus in an initial zero reference condition.

Applicant has found that the automatically controlled sheet feeding apparatus and method of the present invention provides a highly satisfactory and practical means of automatically feeding of the stored sheets into the typewriter without the attention of the operator.

BRIEF DESCRIPTION OF DRAWINGS

The drawings furnished herewith illustrate the best mode contemplated by the inventors of carrying out the subject invention and in which the above advantages and features are fully disclosed as well as others which will be readily understood from the description of such illustrated embodiments.

In the drawing:

FIG. 1 is a front elevational view of a typing apparatus incorporating an automatic sheet feeding device constructed in accordance with the present invention;

FIG. 2 is a side elevational view of FIG. 1 with parts broken away to more clearly illustrate the construction of the present invention;

FIG. 3 is an enlarged elevational view of the drive system constructed in accordance with the present invention;

DESCRIPTION OF ILLUSTRATED EMBODIMENT

Figure 5:
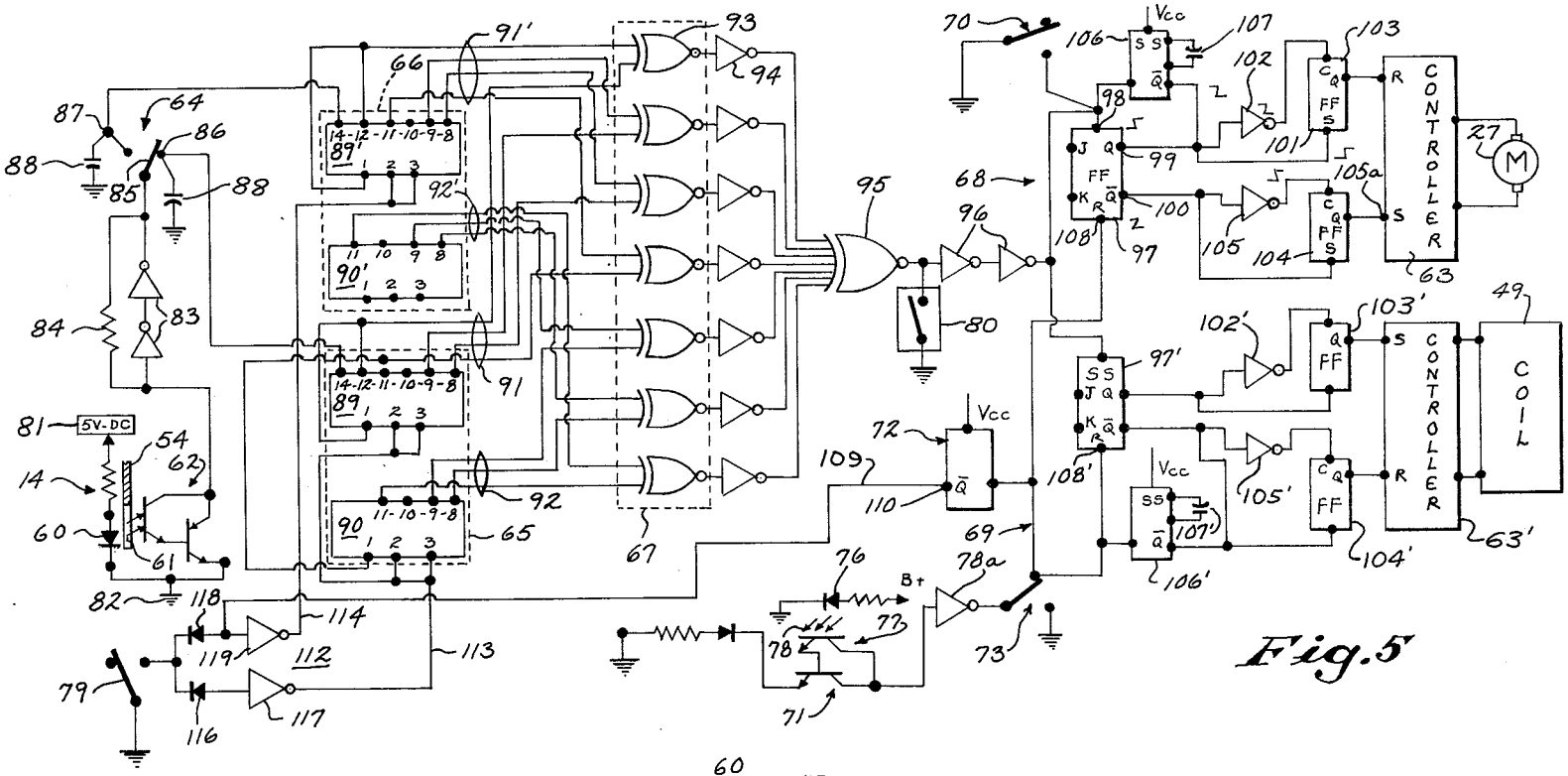
FIG. 5 is a schematic illustration of a feeder drive and control circuit constructed in accordance with the present invention.

Referring to the drawings and particularly FIGS. 1 and 2, the present invention is illustrated in connection with a computerized electric typewriter 1 adapted to be controlled from a memory tape unit 2 mounted to one side of the typewriting apparatus for automatic typing upon a paper sheet 3 properly located in the apparatus. In the illustrated embodiment of the invention, a punched tape 4 of unit 2 forms a record or storage means for material to be reproduced. The tape 4 is sequentially fed past a reader 5 to control the typewriter 1 and provide automatic typing of sequential lines 6 in accordance with wellknown constructions. The typewriter 1 is provided with the conventional keyboard unit 7 for manual typing. In addition, an automatic control section 8, which is manually controlled by the operator is provided with suitable control switches to activate the typewriter 1 for manual typing, for automatic typing in response to the output of the taper reader 5 and the like. As such units are known in the art and are readily available, no detailed description thereof is given. The unit may of course be any other type of automatic typewriting means such as that controlled from a magnetic tape if desired.

In accordance with the present invention an automatic paper feeder 9 is mounted immediately above the platen unit 10 of the typewriter 1 for automated feed of individual sheets 3 into the typewriter. The illustrated paper feeder 9 is basically similar to that shown in the previously referred to U.S. Pat. No. 3,430,748. The present invention is particularly directed to a novel automatic drive control for the paper feeder 9 permitting the independent programming and activation of the feeding of a new sheet into the typewriter. Generally, in accordance with the present invention, a clutch 12 or other disengageable coupling means is connected in the coupling of the typewriter platen unit 10 to the conventional ratchet indexing or drive mechanism 13. In addition, a step or line counting mechanism 14 is coupled to the platen drive mechanism 13 to the conventional ratchet drive side of the clutch mechanism 12. The line counting mechanism 14 is activated only during the actual typing operation and develops a control signal which is compared with a preset signal, such as hereinafter described, to permit typing of a predetermined number of lines 6 on each of the infed sheets 3. When the predetermined number of lines 6 has been passed through the typewriter 1, the clutch mechanism 12 and feeder 9 are automatically activated to transfer a subsequent sheet 3 into the typewriter 1.

More particularly the sheet feeder 9 includes a basic supporting tray structure having a back feed magazine for storing of a plurality of individual sheets 15 such as paper for successive delivery into the typewriter while as a second forward storage magazine formed by intermediate wall members 16 receives the paper or sheets 17 after passing through the typewriter.

The illustrated tray structure includes a pair of sidewalls having depending frame members 18 concentrically mounted on the platen shaft 19 to properly locate a pair of sheet feed rollers 20 and 21 above the platen 10 and support the feeder 9 on the typewriter. The frame members 18 are shown mounted to the shaft by suitable bronze bearings 22 to support the feeder on the shaft 19 without interfering with the rotation of the shaft and attached platen 10. The pair of rollers 20 and 21 are located generally centrally of the tray structure immediately beneath the magazines and particularly the feed magazine for blank sheets 15. The inner most roller 21 is preferably an idler roller having a stepped surface formed to sucessively guide individual sheets 15 into and between itself and the forward positively drive roller 20 which is selectively driven to feed the sheet 15 downwardly from the magazine and into the typewriter between the platen 10 and suitable guide rolls 23 and a curved metal guide wall 24. The guide rolls 23 press the paper 3 onto the platen 10 in accordance with a conventional construction. The feed and idler rollers 20 and 21 are preferably adjustably mounted to permit accurate alignment with respect to the platen 10. The typed sheet 3 moves through the typewriter as the typing progresses, with the upper end moving upwardly toward the filled sheet magazine. A guide wall 24a directs the sheet 3 into the magazine and between the feed roller 20 and an idler pressure roller 25 for position transfer to storage with previously filled sheets 17.

The further details of the particular tray structures, the roller structures and associated equipment may be as disclosed in the previously reference patent, or may be of any other suitable construction, and no further description is setforth herein other than as necessary to adequately and fully describe the operation of the present invention.

In accordance with the present invention, the feed roller shaft 26 is positively driven from a separate drive motor 27 and is coupled to the platen shaft 19 to maintain precise corresponding movement therebetween.

A feed roller gear 28 is secured to the feed roller shaft 26 and to a drive shaft 29 of motor 27 through a speed reducing gear unit 30. The motor 27 and gear reducer unit 30 are mounted to one magazine frame 18 by a motor mount 31 and a rubber isolating motor connector 32. Energization of the motor 27 thus drives the gear 28 and feed roller 20. A coupling belt 33 connects the gear 28 to a similar gear 34 on the platen shaft 19 to correspondingly drive the platen 10.

The teeth on the roller feed gear 28 and the platen shaft gear 34 are selected to provide precise interrelated movement of the platen 10 and the feed roller 20 to pass the blank paper 15 into and through the typewriter 1. For example, in a practical construction, the feed roller gear had 18 teeth while the platen gear had 20 teeth.

More particularly, the platen 10 is shown locked to the platen shaft 19 by a pair of adjustable collars 35 to the opposite ends of the platen 10 and adjacent the bearings 22 for the tray frame members 18. The opposite ends of the platen shaft 19 project outwardly and are provided with a suitable hold down sleeve unit 36, of which only the right side is shown, to properly locate and releasably mount the platen 10 within vertical support walls 37 having a suitable releasable latch 38 forming a conventional part of the typewriter 1.

The platen drive unit 13 is a conventional ratchet wheel unit having a ratchet wheel 40 rotatably mounted on the shaft 19 immediately adjacent the platen hold down sleeve unit 36. A conventional ratchet drive 41, such as diagrammatically shown in U.S. Pat. No. 3,430,748, is coupled to the wheel 40 to produce a stepped rotation of the wheel 40 for each desired line advance of the paper 3. In accordance with the illustrated embodiment of the present invention, the wheel 40 is secured to a sleeve 42 as by a lock screw 43 and rotatably mounted on the platen shaft 19 thereby. The sleeve 42 is connected by an adjustable collar 44 to a clutch sleeve 45.

The clutch mechanism 12 couples the platen shaft 19 to the sleeve 45 and thus to the ratchet wheel 40. The clutch mechanism 12 is mounted to the outer end of a generally L-shaped mounting bracket 46 which is secured to the side frame 18 and extended outwardly parallel to the platen shaft assembly. A clutch arm 47 is secured to the L-shaped bracket and supports a clutch housing 48 encircling the shaft 19. A clutch solenoid coil 49 within housing 48 is concentrically mounted of the shaft 19. Th field of coil housing 48 is coupled to shaft 19 by a lock collar 50 and set screws 51 and includes an annular plate 52 adapted to be magnetically coupled to an opposed annular clutch plate 53 rotatably secured to the ratchet driven sleeve 45 as by set screws 53a. When the coil 49 is energized the clutch plates 52 and 53 are in driving connection and lock the platen shaft 19 and sleeve 45 together. When de-energized, the clutch plates may rotate relative to each other to provide selective decoupling and the platen shaft 19 may be rotated independently of the drive 13 for separate rotation of the platen 10 and related positioning of a sheet 3.

The counting mechanism 14 is shown as a photoelectric coupling unit which includes the opaque counter disc 54 secured to the clutch sleeve 45 by a suitable collar 55. The counting disc 54 is provided with a plurality of equicircumferentially spaced slots 56. The disc 54 is preferably formed with twenty-seven slots corresponding to the usual ratchet wheel 40. The alternate slots and disc portions pass through a generally U-shaped coupling frame 57 which is mounted by a slotted bracket 58 and adjustable bolted connection 59 to the outer end of the main L-shaped bracket 46. The adjustable bracket 58 permits accurate location of the U-shaped coupling frame 57 over the periphery of the disc 54. A suitable lamp 60 is mounted in the one depending arm of the U-shaped coupling frame 57 and establishes a light beam 61 directed to a photosensitive element 62 mounted in the opposite arm. The openings or slots 56 in the counting disc 54, which functions as an encoding element to actuate a memory unit as hereinafter described, are accurately located in accordance with the teeth of the ratchet drive wheel 40 such that a predetermined interruption of the light beam 61 is created for each platen rotation created by the ratchet drive, which in accordance with the convention operation of the typewriter advances the paper 3 for successive typing lines 6. For example, a single interruption of the beam 61 may be created for each one line movement of the platen 10.

In the illustrated embodiment of the invention, the coupling tubular collar 44 interconnects the ratchet sleeve 42 to the clutch and counter sleeve 45 to accomodate any variation in the length of the platen shaft 19.

With the electromagnetic clutch 12 energized, the platen shaft 19 is coupled to the ratchet sleeve 42 as previously described such that a corresponding drive of the platen 10 and the interconnted paper feed drive gear 28 is established by operation of the ratchet element 45. The synchronized drive of the feed roller and platen maintains continuous and accurate feeding of the sheet 3 to and through the typewriter 1 during the typing operation.

The motor 27 and the clutch 12 are synchronously controlled to alternately couple the feed system to the motor 27 for automatic feeding of a new sheet 15 into the typewriter 1 and to the ratchet unit 13 for stepped movement for typing. A satisfactory circuit incorporating a novel counting control is shown schematically in FIG. 4 wherein the counting unit or assembly 14 actuates a control circuit, the output of which provides a selective energization of an AC motor controller 63 and the coil 49 of the electromagnetic clutch.

More particularly in the embodiment of the invention the output of the line counting unit 14 is selectively connected by a manually operated switch unit 64 to a presettable memory counter 65 and alternately to a run counter 66. The memory counter 65 is operated to store the desired number of lines to be placed on each sheet by an initial setup pass of a sheet 3 through the typewriter 1 under the manual control of the operator. The run counter 66 is then operated in synchronism with the typing operation of the typewriter 1 to monitor the movement of the sheet 3 and provide a record of the completed number of lines on the subsequent sheet 3. The memory counter 65 and run counter 66 are connected to a comparator 67. When the predetermined number of lines have been typed on the subsequent sheet, the output of the comparator 67 generates a signal to energize the motor controller 63 and the electromagnetic coil 49. In the illustrated embodiment of the invention of FIG. 4, separate drive channels 68 and 69 are shown connecting the output signal to the respective controls. The separate drive channels 68 and 69 may be employed to ensure adequate driving power for operation of the motor and the electromagnetic coil.

A manual feed control switch unit 70 is provided and connected directly to the drive channels 68 and 69 to permit energization of the motor 27 and de-energization of the electromagnetic coil 49 for individual feeding of one sheet 15 into the typewriter 1. Once the motor and coil circuits are established they are maintained energized until a stop feed switch unit 71 indicates proper feeding of the new paper 15 is completed. In addition, the stop feed switch unit 71 generates a signal feedback via a coupling circuit 72 to reset the run counter 66 only. Thus, when the new sheet 15 is fed to the typewriter 1 the run counter 66 is reset to thereby condition the typing apparatus to recycle and again type the same number of lines on the newly inserted sheet. The switch unit 71 also includes a manual stop switch 73. The stop feed switch unit 71 is mounted as part of the feeder 9 to sense the position of the incoming sheet 3, as shown in FIG. 2, as it moves over an inclined waLL 24*a* which guides the sheet into a track 75 to the discharge idler roller 25 for positive withdrawal of the filled sheet 17. The feed switch unit 71 may be a simple mechanical switch actuated by the leading edge of the paper 3 or may be a photosensitive switch unit as illustrated, which is controlled by incoming paper 3. The unit 71 thus is shown including a photo diode 76 and a photosensitive transistor 77 mounted in the path of sheet 3, which operates to break the light beam 78 and de-energize the motor 27 and clutch coil 49, as presently described.

A manual reset switch 79 is illustrated connected to reset both of the counters 65 and 66 to permit initial reference setting of the counters. Briefly, the operator actuates switch 79 to reset the counters 65 and 66. Switch 64 is set to connect the counting unit 14 to the memory counter 65. The operator actuates switch 70 on the control section 8 of typewriter 1 which sets channels 68 and 69 to automatically feed in a blank sheet 15 into proper position, with the feed automatically terminating in response to operation of stop switch unit 71. The typewriter 1 is then started by the operator to begin typing. When the proper number of lines are typed, the operator manually terminates the automatic typing, and again actuates switch 70 to remove the typed sheet 3 and automatically insert a new blank sheet 15. The switch 64 is now set to the run position and the typewriter 1 actuated in the automatic position. The typing now proceeds with the counting unit 14 driving the run counter 66. When the comparator 67 senses the same relative setting of counters 65 and 66, an output signal is created which energizes the channels 68 and 69 to automatically feed in a new sheet 15 and to terminate the operation of the typewriter for a preselected time during which the sheet 15 is fed into the typewriter. Thus, a suitable electrical timer 80 may be coupled in the cycling control. At the end of the feeding, the coupling circuit 72 resets the run counter 66. The typewriter 1 times out and automatically recycles. The apparatus will continue to recycle, placing the same number of lines on the successive sheets.

Figure 4:
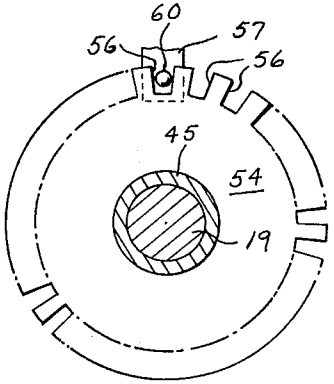
FIG. 4 is a sectional view taken generally on line 5—5 of FIG. 3.

More particularly, in the illustrated embodiment of the invention of FIg. 4, the counting unit 14 includes a light emitting diode as the lamp 60 connected to a logic power supply 81 for establishing the light beam 61. A photo transistor is mounted as the photosensitive element 62 in opposed relation to the light emitting diode 60 and is energized thereby. The photo transistor 62 is normally off, and is based to conduct by the beam 61. The photo transistor 62 is connected in series between ground 82 and a pair of series connected logic inverters 83 to selectively open and break the circuit to the switch 64 in accordance with the energization of the photo transistor 62. A protective resistor 84 is shown connected in parallel with the two cascaded inverters 83. Rotation of the disc 54 interrupts the photo beam and results in a pulsed opening and closing of the circuit, thereby producing a pulsed output connected via the selection switch unit 64 to counters 65 and 66.

The illustrated switch 64 includes a common pole 85 connected selectively to a memory contact 86 or a run contact 87. The contacts 86 and 87 are also connected to ground through suitable similar transient signal protective capacitors 88.

Each of the counters 65 and 66 is similarly constructed as a suitable digital counter unit and are illustrated with a pair of interconnected 4-bit digit counters 89 and 90 to produce a binary coded decimal output. Counter 65 is described with the elements of counter 66 identified with primed numbers. The counter 89 is for the least significant digit and has a set of four binary output signal lines 91 for the digits between zero and nine. The second digit counter 90 includes three output lines 92 as it is assumed that the most significant digit will never as a practical metter exceed the number permitted by the three binary outputs. If an expansion is required for any reason the decade counters can be readily expanded.

The run counter 66 is similarly constructed with the pair of four bit counters 89' and 90' and with the corresponding least significant digit output lines 91 and 91' and the most significant digit output lines 92'.

The several output lines 91, 91' and 92, 92' of the two counters 65 and 66 are connected to the comparator 67 which in the illustrated embodiment of the invention, includes a plurality of individual exclusive OR gates 93 to individually compare the output state of the corresponding lines 91 and 91' and 92 and 92'. Thus, seven gates are illustrated for comparing of the count signals. The OR gates are each two input gates of any desired or well known construction, and in accordance with conventional characteristic will respond to corresponding inputs to provide the desired logic output signals. The output of each of the several OR gates 93 is connected by an inverter 94 to the input of a summing NAND gate 95. The exclusive OR gates 93 all indicate a corresponding compared input only when a corresponding count exists in the counters 65 and 66, and only then are all inputs removed from the NAND gate 95 so as to produce an output signal which requests a new sheet. The output of the NAND gate 95 is coupled through a pair of series inverters 96, to activate the motor control channel 68 and the solenoid control channel 69, as follows. Both of the channels 68 and 69 are generally similarly constructed and the motor control channel 68 will be described in detail with corresponding elements of the coil channel 69 identified by similar primed numbers.

The motor control channel 68 includes a flip-flop unit 97 of the well-known JK type. The set input 98 is connected to the output of the inverter 96. The flip-flop unit 97 includes a positive output 99 at a normal high level output and a not output 100 at a normal low output which is reversed by setting of the flip-flop unit. The positive output 99 is coupled directly to the set input of a clocked reset flip-flop 101 and through an inverter 102 to the clock input of the clocked flip-flop 101. The positive output of unit 101 is connected to the reset input of main driving flip-flop unit 103, the output of which is connected to drive the motor controller 63 which may be a simple relay circuit with a solid state series switch. Thus, the unit is cleared in response to a logic "1" at the terminal 98, and the controller gate 103 is reset by a logic "1" via the signal to the set input of the flip-flop unit 101.

The not output 100 of the flip-flop unit 97 is similarly connected to the set input of a clocked flip-flop unit 104. The clock input of the unit 104 is connected through an inverter 105 to the not output 100. The positive output of the second flip-flop unit 104 is connected directly to the set input 105*a* of the AC driver controller 63. Thus, the logic at the not output 100 sets the flip-flop unit 104 to activate the controller 63.

A one-shot unit 106 has its input connected in common with the set input 98 of the flip-flop unit 97. A timing capacitor 107 is connected to produce a selected delayed pulse and has the not output of unit 106 connected in circuit in common with the positive output 99 of flip-flop 97. It thus produces a delay signal at the not output in response to the signal at the input. The length of the one-shot pulse signal is controlled by the size of the capacitor 107 and is selected in accordance with the maximum running time for feeding of a sheet 3 into the typewriter 1. The one-shot unit 106 functions to provide an overriding timed control on the controller operation in response to a start signal to automatically terminate operation if the unit does not terminate operation automatically or in response to an operator control, as presently described.

The one-shot unit 106 and the set input 98 of the JK flip-flop unit 97 are also connected to ground through the manual form feed control switch 70. The closing of the switch 70 simulates the receipt of a logic "0" signal of the comparator network 67 and NAND gate 95 to provide a corresponding signal to the motor energizing circuit.

The motor is maintained energized until such time as the flip-flop unit 97 is reset or the overriding timer 106 times out. The unit 97 is automatically reset by grounding of the reset terminal 108. In the illustrated embodiment of the invention, the reset terminal 108 is connected to ground by the paper position sensing switch 71 or the manual stop switch 73. As a new sheet of paper 3 moves through the typewriter 1, and particularly into the entrance area of the storage chamber, the light beam is directed to activate the switch 71 and through the inverter 78*a* actuating the reset line and resetting the flip-flop unit 97. The resetting of the flip-flop unit 97 of course reverses the output condition with a similar logic signal chain through the channel 68 to set unit 101 which resets controller 63 and stops the motor 27.

The electromagnetic clutch coil channel 69 is similarly constructed to provide an AC driving output for energizing of the coil 49. The channel for the coil 49, however, has the set and reset reversed so as to energize the coil for producing a driving connector during normal typing and de-energize the coil during automatic paper feeding. Thus the positive output of the input flip-flop unit 97' is connected to control the set terminal of the AC controller and the not output of the flip-flop unit 97' is connected to the reset terminal. The one-shot unit 106' is similarly coupled to the not output channel of unit 97', however, to again provide timed control of the reset. Further, the capacitor 107' is of a slightly lower capacitance to increase the period of the signal. Thus, under normal operation the AC coil 49 will be energized to engage the electromagnetic clutch and maintain a continuous drive condition. However, when the input signal is received from the comparator NAND gate 95 to energize the motor 27, channel 69 will simultaneously deactivate the controller 103' and de-energize the coil.

As previously noted, the run counter 66 is reset to zero or reference by a feedback signal with the reset signal to the driving channels 68 and 69. In the illustrated embodiment of the invention, the coupling unit 72 is a one-shot circuit input connected to the reset lines 109 from switches 71 and 73 and one-shot unit 72. The not output 110 of the one-shot unit 72 is connected by a feedback counter line reset to reset the run memory unit or counter only through a common reset circuit 112, as follows.

Each of the memory units 65 and 66 is similary provided with the reset input line 113 and 114 and are reset by a signal at the corresponding reset line through circuit 112 to the common reset switch 79. Thus, the reset line 113 for the memory counter 65 is connected to the ground reset switch 79 in series with a blocking diode 116 and an inverter 117. When the switch is grounded the inverter 117 produces a logic signal transmitted via the diode 116 to reset the counter 65.

The run counter 66 is similarly connected by a blocking diode 118 and an inverter 119 to the ground switch 79 and is similarly activated with the diode 118 biased to conduct when the switch 79 is closed to reset the counter 66. Thus switch 79 is used to reset both counters to a common reference.

When the paper positioning switch 71 is activated, a signal correspondingly resets the flip-flops 97 and 97', with the pulsing of the one-shot unit 106'. The feedback one-shot unit 72 provides a pulse input between the diode 118 and the input of the inverter 119. The signal applied via the inverter 119 directly to the run counter reset line 114 and consequently resets the counter 66 to zero or reference. This reset output signal is blocked from counter 65 by the blocking diode 116 and thus does not reset the memory counter. The typewriter 1 is then in a condition to recycle and type on a new page 3 continuing on where it had left off on the previous page. When the lines typed again equal the line setting of the memory unit 65, a null condition is again created which again cycles the drive for the motor 27 and the coil 49 to remove the typed page and introduce still a new page.

The operation of the typewriter 1 with the automatic feeder or loader 9 is summarized as follows.

The operator loads the feeder 9 with the blank paper 15 and the automatic tape reader 5 with tape 4. The manual form feed switch 70 is activated to establish feeding of a first paper or sheet 3 into the typewriter 1. The typewriter 1 is then activated to automatically type onto the page 3 a predetermined number of lines, with the selection switch 64 in the memory position. The number of lines is determined by the operator which is manually stopped when the proper number of lines has been typed. The memory unit 66 records and stores therein the corresponding number of lines. The selection switch 64 is now set to the run position and the manual form switch 70 is again activated to feed in a second new page 3 which automatically is completed with the activation of the stop feed switch. This also feeds back a reset signal via the one-shot unit 72 to reset the run counter 65 to positively ensure that it starts at a reference or zero input setting.

The operator then activates the automatic runs switch on the typewriter 1, after which the typewriter 1 and feeder 9 will continuously cycle automatically to continuously feed successive sheets into the unit, with each sheet being fed through the typewriter for a corresponding number of lines, until such time as the run has been completed and a new run is desired.

If it is desired to change the number of lines appearing on subsequent sheets, the operator actuates the common reset switch 115 to simultaneously provide a ground signal to the run counter 66 and to the memory counter 65 and the system is reset by sequential manually feeding of the first two shots into the typewriter.

We claim:

1. An automatic sheet feeding apparatus, an automated typing apparatus having a platen, a sheet supply magazine means for storing a plurality of sheet units with an outer exposed sheet unit and having mounting means for mounting the magazine means in overlying relationship to said platen, said magazine means having a lower opening allowing sequential transfer of said sheet units to said platen, said platen mounted on a rotating shaft for successively moving of each of said sheet units through the typing apparatus, a rotating indexing means connected to said platen for sequential moving of each of said sheet units through the typing apparatus in predetermined spaced lines, a feed roller means rotatably mounted to selectively engage said outer sheet unit in the magazine means and moving said outer sheet unit into the platen, an electrical motor, means coupling said motor to said feed roller means and to said platen to provide precise corresponding movement of the platen with the feed roller means, clutch means interposed between the platen and the indexing means of the typing apparatus for coupling and decoupling said platen and indexing means, drive circuit means for energizing the clutch means and motor in timed relation, said clutch means decoupling the indexing means from the platen during the operation of the motor, and encoding means for monitoring the movement of each of said sheet units through the typing apparatus and coupled to the indexing means and rotated in synchronism with the indexing means, said encoding means establishing an output in accordance with the rotation of the indexing means, comparator means having a presettable input means for presetting of the comparator means and being connected to the output of said encoding means and establishing a null signal in response to a selected comparison between said output and said preset input means, and said drive circuit means for said motor and said clutch means connected to the output of the comparator means and having start means responsive to said null signal to activate the motor and clutch means to rotate the feeder roller means and the platen and automatically introduce the outer sheet unit from the magazine means into the typing apparatus, reset means responsive to the null signal to reset the comparator means, stop means to sense the proper location of the last named sheet unit and connected in the drive circuit means to terminate the operation of the motor and the clutch means.

2. The apparatus of claim 1 including means to manually reset the comparator means including the presettable input means, said presettable input means selectively connected to the encoding means for establishing said input means at a selected number of lines, manually operable override switch means for directly activating said drive circuit means for said motor and said clutch means to initiate the automatic feeding of the outer sheet unit into the typing apparatus independently of the output of said comparator.

3. The automatic feeding apparatus of claim 1 wherein the stop means includes a sensor connected in the drive circuit means and establishing a sensing field in the path of the outer sheet unit as said outer sheet unit moves from the typing apparatus and responsive to the leading infed end thereof to activate the stop means.

4. The automatic feeding apparatus of claim 1 wherein said magazine means includes a rear blank-sheet supply magazine for storing said plurality of sheet units and including said lower opening and a forward filled-sheet storage magazine having a lower opening, said feed roller means grasping said sheet unit in the typing apparatus as it approaches the lower opening of the storage magazine to provide corresponding timed movement of the sheet unit in the typing apparatus with the movement of said outer sheet unit into the apparatus.

5. The automatic feeding apparatus of claim 1 wherein said encoding means includes a rotating index disc member and a photoelectric means having a beam source located to one side of the disc and establishing a beam directed to engage the disc, said disc member having alternate portions opaque and transparent to said beam, the rotation of said index disc member producing a train of counting pulses, said encoding means including a beam detector to the opposite of the disc from said beam source, said comparator means including a memory counter, said presettable input means including a run counter, selection means selectively connecting said beam detector to said memory counter and to said run counter.

6. The automatic sheet feeding apparatus of claim 1 wherein said magazine means includes a back blank-sheet supply magazine having said lower opening and a forward filled-sheet storage magazine having a second lower opening, said openings allowing transfer of said sheet units therebetween with respect to said platen, said feed roller means engaging said outer sheet unit in the supply magazine and engaging the sheet unit in the typing apparatus to provide corresponding timed movement of the latter two sheet units, said electrical motor being directly coupled to said feed means, a belt-type drive means coupling said motor to said platen shaft, said clutch means being mounted on said platen shaft and selectively coupling the platen shaft to the indexing means, said encoding means including a counting disc member coupled to the indexing means and rotated in synchronism therewith and a photoelectric means having a beam source located to one side of the disc and establishing a beam directed to engage the disc, said disc member having alternate portions opaque and transparent to said beam, the indexing rotation of said counting disc member producing a train of counting pulses, said encoding means including a beam detector to the opposite of the disc from said beam source, said comparator means including a memory counter, said presettable input means being a run counter, selection means connecting said beam detector to said memory counter and to said run counter, said comparator means having logic gate means connected to said memory counter and said run counter and establishing said null signal in response to counts in the two counters, said reset means being responsive to said null signal to reset the run counter, means to manually simultaneously reset both said memory counter and said run counter, and manual override switch means for directly activating said drive circuit means for said motor and said clutch means to initiate the automatic feeding of said outer sheet unit into the typing apparatus independently of said counters.

7. A sheet unit feeding apparatus, comprising a typing apparatus having a platen for typing on a sheet unit releasably mounted in the typing apparatus, a storage means for storing a plurality of sheet units, powered feed roller means for withdrawing each of said sheet units successively from the storage means and passing each sheet unit into and partially through the typing apparatus, said powered feed roller means including a drive shaft and a powered roller means frictionally engaging the sheet unit in the typing apparatus for removing the latter from the typing apparatus and frictionally engaging one of said sheet units in said storage means for placing the latter into the typing apparatus, a motor connected to said drive shaft, a platen drive means for driving said platen, a coupling means connecting said drive shaft to said platen for simultaneously rotating of the platen with the roller means, said coupling means including a disengageable clutch means for disconnecting of said platen drive means from said platen during operation of said motor, means for operating said clutch means and said motor, stop means coupled to the feed means for sensing the location of the incoming edge of the sheet unit to terminate operation of the feed means, start means for monitoring operation of the typing apparatus and the moving of the sheet unit through the typing apparatus and responsive to a selected movement of the sheet unit to actuate the feed means, said feed means being continuously responsive until said stop means is actuated to automatically remove the sheet unit in the typing apparatus and introduce one of said new sheet units from the storage means into the typing apparatus.

8. The feeding apparatus of claim 7 wherein said powered roller means includes a central roller located beneath the bottom of said magazine means and a sheet introducing roller, means urging said introducing roller into resilient engagement with said central roller and frictionally engaging one of the sheet units in the magazine means, a removing roller located to the opposite side of the central roller from said introducing roller and spaced from said platen and incoming edge of the sheet unit in the typing apparatus accommodating the movement of the sheet unit through the typing apparatus, means urging the removing roller into engagement with the central roller and frictionally engaging the incoming edge of the sheet unit in the typing apparatus for removing of the latter.

* * * * *

UNITED STATES PATENT AND TRADEMARK OFFICE

CERTIFICATE OF CORRECTION

PATENT NO. : 3,963,110

DATED : June 15, 1976

INVENTOR(S) : FRANCIS P. HYLAND ET AL

It is certified that error appears in the above-identified patent and that said Letters Patent are hereby corrected as shown below:

| | | | | |
|---|---|---|---|---|
| Column | 1, | Line | 13, | after "single" cancel "sheets" and insert --- sheet ---; |
| Column | 1, | Line | 14, | after "by" cancel "autucation" and insert --- actuation ---; |
| Column | 2, | Line | 4, | after "monitoring" cancel "the"; |
| Column | 3, | Line | 11, | after "automatically" cancel "groundsing" and insert --- grounding ---; |
| Column | 3, | Line | 16, | cancel "Applicant has" and insert --- Applicants have ---; |
| Column | 3, | Line | 66, | before "reader" cancel "taper" and insert --- tape ---; |
| Column | 5, | Line | 58, | before "field" cancel "Th" and insert --- The ---; |
| Column | 6, | Line | 39, | after "the" (second occurrence) cancel "interconnted" and insert --- interconnected ---; |
| Column | 8, | Line | 37, | after "practical" cancel "metter" and insert --- matter ---; |
| Column | 9, | Line | 11, | after "flip-flop" insert --- unit ---; |

UNITED STATES PATENT AND TRADEMARK OFFICE

CERTIFICATE OF CORRECTION

PATENT NO. : 3,963,110

DATED : June 15, 1976

INVENTOR(S) : FRANCIS P. HYLAND ET AL

It is certified that error appears in the above-identified patent and that said Letters Patent are hereby corrected as shown below:

| | | | | |
|---|---|---|---|---|
| Column | 11, | Line | 27, | before "Claim 1", insert the following paragraph --- Various modes of carrying out the invention are contemplated as being within the scope of the following claims, particularly pointing out and distinctly claiming the subject matter which is regarded as the invention. --- |
| Column 13, CLAIM 7 | | Line | 27, | after "passing" insert --- of ---. |

Signed and Sealed this

Nineteenth Day of October 1976

[SEAL]

*Attest:*

RUTH C. MASON
*Attesting Officer*

C. MARSHALL DANN
*Commissioner of Patents and Trademarks*